United States Patent [19]

Schilke et al.

[11] 4,152,488

[45] May 1, 1979

[54] GAS TURBINE BLADE TIP ALLOY AND COMPOSITE

[75] Inventors: Peter W. Schilke, Scotia, N.Y.; David N. Duhl, Newington, Conn.

[73] Assignee: United Technologies Corporation, Hartford, Conn.

[21] Appl. No.: 793,334

[22] Filed: May 3, 1977

[51] Int. Cl.[2] ..... B32B 15/04

[52] U.S. Cl. ..... 428/678; 75/171; 148/6; 148/32.5; 428/680

[58] Field of Search ..... 75/171, 170; 148/32, 148/32.5, 6; 428/678, 680

[56] References Cited

U.S. PATENT DOCUMENTS

| | | | |
|---|---|---|---|
| 3,754,902 | 8/1973 | Boone et al. | 75/171 |
| 4,013,424 | 3/1977 | Wildgoose et al. | 75/171 |

*Primary Examiner*—R. Dean

*Attorney, Agent, or Firm*—Charles E. Sohl

[57] ABSTRACT

A nickel base superalloy having a composition which provides a desirable combination of good oxidation and corrosion resistance and hot hardness is described. The alloy contains 21–25% Cr, 4.5–7% Al, 4–10% W, 2.5–7% Ta, 0.5–0.15% Y and 0.1–0.3% C. This alloy is useful as a blade tip element in a composite gas turbine blade.

11 Claims, No Drawings

GAS TURBINE BLADE TIP ALLOY AND COMPOSITE

BACKGROUND OF THE INVENTION

1. Field of the Invention

This invention relates to nickel base superalloys which have oxidation resistance, high, hot hardness and abrasion resistance. This invention also relates to composite blades for gas turbine engines.

2. Description of the Prior Art

The requirements of the application for which the present invention is intended is unique. For this reason, there does not appear to be a great deal of prior art which is directly pertinent to the present invention. U.S. Pat. No. 2,994,605 discloses a nickel base alloy containing 40–80% Ni, 10–25% Cr, 0.25–5% (Cb+Ta), 0.5–8% (Mo+W) and 0.25–3% Al. This alloy does not contain yttrium and the aluminum range is below that contemplated by the present invention. Further, the reference teaches columbium and tantalum as being equivalent and tungsten and molybdenum as being equivalent and these equivalences are not valid for the alloy of the present invention. U.S. Pat. No. 3,905,552 discloses the addition of about 0.1% Y to nickel base superalloys for improved forgeability. Yttrium in superalloys is also discussed in U.S. Pat. Nos. 3,516,826; 3,346,378 and 3,202,506.

SUMMARY OF THE INVENTION

The alloy of the invention is a nickel base superalloy which is predominately comprised of the gamma, gamma prime and beta phases. Additions of chromium and yttrium are made to improve the hot corrosion and oxidation resistance. Additions of tungsten, tantalum and carbon are made to improve the hot hardness and abrasion resistance at elevated temperatures. The nominal composition of the alloy is 24% Cr, 5.75% Al, 7.5% W, 4.25% Ta, 0.08% Y and 0.2% C. The alloy has high, hot hardness, abrasion resistance and resistance to hot oxidation and corrosion. The alloy is useful as a blade tip element on a composite superalloy gas turbine blade.

The foregoing and other features and advantages of the present invention will become more apparent in the light of the following detailed description of preferred embodiments.

DESCRIPTION OF PREFERRED EMBODIMENTS

Improved efficiency is an increasingly important factor in the development of gas turbine engines. Such engines have rows of rotating blade within a generally cylindrical case. Leakage of gas between the ends of the rotating blades and the case contributes towards engine inefficiency. This leakage can be minimized by designing blade and seal systems in which the blade tip rubs against a seal which is attached to the case of the engine. In the turbine section of the engine, where sealing problems are particularly troublesome, the blade tip temperature may approach or exceed 2000° F. and a combination of this temperature with corrosive gases and abrasion against the seal assembly can cause significant blade tip degradation problems.

This invention relates to a nickel base superalloy which is particularly useful for blade tip applications in gas turbine engines. Most prior art nickel base superalloys have been developed for optimum mechanical properties such as creep strengths and ductility. A majority of the prior art superalloys are employed in a coated form for oxidation and corrosion resistance. The alloy of the present invention has been developed to have a high degree of inherent oxidation resistance, since in blade tip applications coatings are not effective because of the rubbing problems. The alloy of the present invention has also been optimized for hot hardness and resistance to abrasion at elevated temperatures. The alloy of the invention was developed to have a hot hardness comparable to the hot hardness of conventional superalloys and a resistance to oxidation and hot corrosion superior to that of prior art superalloys, approaching that of coating alloys. Hot hardness and abrasion resistance are necessary for blade tip applications since it is more economical to replace the seal assembly rather than the whole blade assembly when wear has become excessive. In the application for which the alloy is intended, as a blade tip over a very short portion of the blade length, mechanical properties such as creep strength, ductility and the like are comparatively unimportant. Hence, the alloy of the invention has not been optimized with respect to these properties, which are comparatively unimportant in the intended application, although such properties are completely adequate in the invention alloy for the intended use. Likewise, conventional superalloy compositions are controlled to prevent the formation of undesirable phases under conditions to which the material will be exposed in service. These phases include phases known as sigma and mu. Such phases commonly form at intermediate temperatures and are deleterious because they are usually brittle. For the application to which the present invention is directed, such phases are not a problem and therefore the present invention composition has not been constrained to prevent the formation of such phases. The present invention alloy combines the hardness of conventional structural nickel base alloys with the corrosion of prior art coating compositions.

Unless otherwise indicated, all percentages in this application are weight percentages. The present invention contains 21–27% Cr, 4.5–7% Al, 5–10% W, 2.5–7% Ta, 0.02–0.15% Y and 0.1–0.3% C. Of course certain substitutions may be made without departing from the realm of the invention. Cobalt has been found to improve the sulfidation resistance of the invention alloy without detrimentally affecting other properties. Accordingly, it may be present in levels up to about 20%, and is preferably present in levels of from 5–20% in alloys of the invention which will be used in environments where sulfidation is a problem. Molybdenum has been found to be detrimental in terms of hot corrosion resistance and accordingly it is not an intentional addition and its content as an impurity should be limited to less than about 0.2%. Titanium may be substituted for a portion of the aluminum content (on an equal atomic basis) but a substantial substitution of titanium for aluminum will decrease the oxidation resistance of the alloy. For this reason the maximum titanium substitution is preferably no greater than one-fifth of the aluminum content. Likewise, while columbium might be substituted for a portion of the tantalum (on an equal atomic basis), such a substitution will generally be detrimental to oxidation resistance. Accordingly, the maximum columbium substitution should be less than one-fifth of the tantalum content. Some prior art indicates that rhenium strengthens superalloys in a similar fashion to the effect produced by tungsten. In the present alloy system, rhenium is no more effective than tungsten, and economic considerations make the use of rhenium undesirable. Up to about one-half of the yttrium content may be replaced by an equal atomic amount of an oxygen active element selected from the group consisting of Ce, La, Hf, Zr, and mixtures thereof. Larger additions of about 2% Hf were made to the alloy and had neither beneficial or detrimental effects. A combination of boron and zirconium in levels of 0.05–0.2% might be added to promote boride formation.

A preferred composition range for gas turbine blade tip applications is 25–27% Cr, 5–7% Al, 7–9% W, 2–5% Ta, 0.05–0.15% Y and 0.15–0.25% C.

The present invention composition is particularly useful as a tip element on blades formed of conventional nickel base superalloys. Such blades will have composition generally within the limits set forth in Table I and the blade and root portions may be of conventional equiaxed grain microstructure, columnar grain microstructure or single crystal microstructure. Columnar grain blades are described in U.S. Pat. No. 3,260,505 which is assigned to the assignee of the present invention and incorporated herein by reference. Single crystal blades are described in U.S. Pat. No. 3,494,709 which is also assigned to the assignee of the present invention and incorporated herein by reference. The thickness of the blade tip will generally be less than about 0.2 inch.

TABLE I

| Elements | Percentage |
|---|---|
| Carbon | .01–.25 |
| Chromium | 5–25 |
| Tungsten | 0–15 |
| Molybdenum | 0–10 |
| Cobalt | 0–25 |
| Columbium | 0–5 |
| Tantalum | 0–5 |
| Titanium | .5–5 |
| Aluminum | .5–7 |
| Aluminum & Titanium | 2–10 |
| Boron | 0–.2 |
| Zirconium | 0–.5 |
| Hafnium | 0–3.0 |

Such a composite blade article forms a part of the present invention.

The alloy of the present invention may be fabricated into blade tips and applied to blades in a variety of ways. Fabrication techniques for blade tip preforms include casting and powder metallurgy processes. Attachment techniques include solid state diffusion bonding, TLP TM bonding, brazing, plasma spray processes, and electron beam evaporation. Solid state diffusion bonding employs a combination of heat and pressure to induce bonding. TLP bonding employs an interlayer which contains a melt depressant. In the bonding sequence the interlayer is heated to above its melting point and allowed to solidify isothermally as the melting point depressant diffuses into the articles being joined. TLP bonding is described in U.S. Pat. No. 3,678,570 which is assigned to the assignee of the present invention and is incorporated herein by reference. Brazing might be used as an application technique but its utility is limited by the properties of the brazed joint at the engine operating conditions. Plasma spraying involves the melting and spraying of the invention alloy onto the blade tip. Present electron beam evaporation equipment does not have the capability to deposit a material such as the present alloy because of the presence of high melting point, low vapor pressure constituents such as Ta and W, however, it is anticipated that future generations of electron beam apparatus will have this capability.

Table II compares properties which are significant in blade tip applications of the invention alloy and certain other prior art alloys. The invention alloy is shown in two forms produced by casting, and by powder metallurgy. D.S. MAR-M200 is a currently used structural superalloy tested in polycrystalline columnar grained form. MAR-M509 is a cobalt base alloy which is used as a seal material in gas turbine engines. NiCoCrAlY and CoCrAlY are state of the art coating compositions. Cabot alloy 103, IN-738 and Haynes 188 are prior art superalloys having a good balance between mechanical properties, such as hot hardness, and inherent oxidation resistance. These latter three alloys were evaluated as potential blade tip alloys. Nominal compositions of all of these alloys are presented in Table III.

TABLE II

| Alloy | Hot Hardness (VPN) 1800° F. | Hot Hardness (VPN) 2000° F. | 100 Hour Cyclic Oxidation Resistance[1] 2000° F. | 100 Hour Cyclic Oxidation Resistance[1] 2100° F. | 100 Hour Cyclic Hot Corrosion Resistance[2] | |
|---|---|---|---|---|---|---|
| D.S. MAR-M200+Hf | 180 | 72 | II | II | III | (3) |
| MAR-M509 | 28 | 24 | — | — | — | (4) |
| NiCoCrAlY (by physical vapor deposition) coating | 20 | <10 | I | — | I | (5) |
| CoCrAlY (plasma sprayed) coating | 48 | 15 | I | — | I | (6) |
| Cabot Alloy 103 | 70 | 26 | III | — | III | (7) |
| IN-738 | 73 | 38 | III | — | III | (8) |
| Haynes 188 | 65 | 26 | III | — | II | (9) |
| Invention Alloy (cast) | 111 | 56 | — | I | II | (1) |
| Invention Alloy (vacuum hot pressed powder) | 111 | 56 | — | I | II | (2) |

I - Exhibits minimal or no internal corrosion/oxidation and/or minimal or no oxide spallation.

II - Exhibits some internal corrosion/oxidation and/or some oxide spallation.

III - Exhibits massive internal corrosion/oxidation and/or massive oxide spallation.

[1]Specimens cycled at each 20 hour interval.

[2]Specimens coated with 1mg/cm$^2$ of $Na_2So_4$ at each 20 hour cycle and tested at 1835° F.

TABLE III

| Alloy | Elements (Weight %) | | | | | | | | | |
|---|---|---|---|---|---|---|---|---|---|---|
| | Co | Ni | Cr | Al | W | C | Others | | | |
| NiCoCrAlY (by physical vapor deposition) coating | Bal. | — | 23.0 | 13.0 | — | — | 0.6Y | | | |
| CoCrAlY (plasma sprayed) | 23.0 | Bal. | 18.0 | 12.5 | — | — | 0.3Y | | | |
| Haynes 188 | Bal. | 22.0 | 22.0 | — | 14.5 | 0.1 | 0.08La | | | |
| IN-738 | 8.5 | Bal. | 16.0 | 3.4 | 2.6 | — | 3.4Ti | 1.7Mo | 1.8Ta | 0.15B, 0.85Cb, 0.12Zr |
| Cabot Alloy 103 | Bal. | 3.0 | 31.0 | — | 12.0 | 2.5 | 3.0Fe | 1.0Si | 1.0Mn | 1.0B |
| D.S. MAR-M200 + Hf | 10.0 | Bal. | 9.0 | 5.0 | 12.5 | 0.11 | 2.0Hf | 1.0Cb | 2.0Ti | |
| MAR-M509 | Bal. | 10.0 | 23.5 | — | 7.0 | 0.6 | 3.5Ta | 0.2Ti | 0.5Zr | |

Comparing the hot hardnesses of the various alloys, it can be seen that at both 1800° F. and 2000° F. the invention alloy is harder than any other alloy tested except for the blade alloy, D.S. MAR-M200. The invention alloy is more than twice as hard as the seal alloy (MAR-M509) at both temperatures, indicating that the seal alloy would wear preferentially to the blade tip (invention) alloy.

Cyclic oxidation tests revealed that the invention alloy is superior to the blade alloy at 2100° F. while hot corrosion tests indicate that the alloy is also superior to the blade alloy. The invention alloy is also more resistant to hot corrosion than the structural alloys Cabot alloy 103, and IN-738. The data presented in Table II gives a clear indication that the alloy of the present invention has a unique combination of the properties which are important in gas turbine blade tip applications.

Although this invention has been shown and described with respect to a preferred embodiment thereof, it should be understood by those skilled in the art that various changes and omissions in the form and detail thereof may be made therein without departing from the spirit and scope of the invention.

Having thus described a typical embodiment of our invention, that which we claim as new and desire to secure by Letters Patent of the United States is:

1. A corrosion resistant nickel base superalloy having high, hot hardness and high abrasion resistance consisting essentially of:

about 21–27% Cr, about 4.5–7% Al, about 5–10% W, about 2.5–7% Ta, about 0.02–0.15% Y, about 0.1–0.3% C, balance essentially nickel.

2. An alloy as in claim 1 which also contains up to about 20% cobalt.

3. An alloy as in claim 1 wherein up to about one-fifth of the aluminum content is replaced by an equal atomic amount of titanium and up to about one-fifth of the tantalum content is replaced by an equal atomic amount of titanium.

4. An alloy as in claim 1 wherein up to about one-half of the yttrium content is replaced by an equal atomic amount of an oxygen active element selected from the group consisting of Ce, La, Hf, Zr, and mixtures thereof.

5. An alloy as in claim 1 which contains about 23–27% Cr, about 5–7% Al, about 7–9% W, about 3–5% Ta, about 0.05–0.15% Y, about 0.15–0.25% C, balance essentially nickel.

6. A composite blade useful in gas turbine engine consisting of a nickel base superalloy root and blade portion and a tip portion bonded thereto consisting of about 21–27% Cr, about 4.5–7% Al, about 5–10% W, about 2.5–7% Ta, about 0.02–0.15% Y, about 0.1–0.3% C, balance essentially nickel, said tip portion, having hot hardness properties similar to those of the root and blade portion and having oxidation and hot corrosion properties which are superior to those of the root and blade portion.

7. A composite blade as in claim 6 wherein the blade tip contains about 23–27% Cr, about 5–7% Al, about 7–9% W, about 3–6% Ta, about 0.05–0.15% Y, about 0.15–0.25% C, balance essentially nickel.

8. A composite blade as in claim 6 wherein the root and blade portion have an equiaxed polycrystalline microstructure.

9. A composite blade as in claim 6 wherein the root and blade portion have a polycrystalline columnar microstructure.

10. A composite blade as in claim 6 wherein the root and blade portion have a single crystal microstructure.

11. A method for protecting gas turbine blade tips from oxidation, corrosion, and abrasion, which comprises alloying a layer of a nickel base superalloy to the blade tip, said superalloy consisting essentially of about 21–27% Cr, about 4.5–7% Al, about 5–10% W, about 2.5–7% Ta, about 0.02–0.15% Y, about 0.1–0.3% C, balance essentially nickel.

* * * * *

UNITED STATES PATENT AND TRADEMARK OFFICE

CERTIFICATE OF CORRECTION

PATENT NO. : 4,152,488
DATED : May 1, 1979
INVENTOR(S) : PETER W. SCHILKE ET AL

It is certified that error appears in the above-identified patent and that said Letters Patent are hereby corrected as shown below:

| | |
|---|---|
| TABLE III, line 5 | after "(plasma sprayed)" add -- coating -- |
| TABLE III, line 7 | "0.15B" should read -- 0.015B -- |

Signed and Sealed this

*Twenty-first* Day of *April 1981*

[SEAL]

*Attest:*

RENE D. TEGTMEYER

*Attesting Officer* *Acting Commissioner of Patents and Trademarks*